US006551545B1

(12) United States Patent
Hutter et al.

(10) Patent No.: US 6,551,545 B1
(45) Date of Patent: Apr. 22, 2003

(54) METHOD AND APPARATUS FOR MELT SPINNING A MULTIFILAMENT YARN

(75) Inventors: Hans-Gerhard Hutter, Remscheid (DE); Klaus Schäfer, Remscheid (DE); Dieter Wiemer, Wermelskirchen (DE); Hansjörg Meise, Köln (DE); Detlev Schulz, Radevormwald (DE)

(73) Assignee: Barmag AG, Remscheid (DE)

( * ) Notice: Subject to any disclaimer, the term of this patent is extended or adjusted under 35 U.S.C. 154(b) by 236 days.

(21) Appl. No.: 09/649,624

(22) Filed: Aug. 28, 2000

(30) Foreign Application Priority Data

Aug. 26, 1999 (DE) ..... 199 40 591

(51) Int. Cl.[7] ..... D01D 5/084; D01D 5/092; D01D 5/098; D01D 5/14; D02G 3/00

(52) U.S. Cl. ..... 264/555; 264/101; 264/103; 264/210.8; 264/211.12; 264/211.14; 264/211.15; 264/211.17; 425/66; 425/72.2; 425/377; 425/378.2; 425/379.1; 425/382.2

(58) Field of Search ..... 264/101, 103, 264/210.8, 211.12, 211.14, 211.15, 211.17, 555; 425/66, 72.2, 377, 378.2, 379.1, 382.2

(56) References Cited

U.S. PATENT DOCUMENTS 4,277,430 A 7/1981 Peckinpaugh et al.
5,976,431 A 11/1999 Mears
6,013,223 A * 1/2000 Schwarz ..... 264/555

FOREIGN PATENT DOCUMENTS

JP 04041711 A * 2/1992 ..... 264/211.17

* cited by examiner

*Primary Examiner*—Leo B. Tentoni
(74) *Attorney, Agent, or Firm*—Alston & Bird LLP

(57) ABSTRACT

A method and an apparatus for melt spinning a multifilament yarn from a thermoplastic material, wherein a spinneret extrudes the thermoplastic material to strandlike filaments, which are initially in liquid form and then cooled to cause their solidification. For purposes of cooling, the filaments are precooled in a cooling zone downstream of the spinneret in such a manner that the filaments do not solidify. Subsequently, the filament bundle advances by the action of a coolant stream directed in the direction of the advancing yarn into a tension zone and undergoes further cooling until the filaments solidify in a solidification zone within the tension zone. To maintain the location of the solidification zone within the tension zone in a predetermined desired range thereof, an adjustable cooling of the filaments within the cooling zone is provided.

23 Claims, 4 Drawing Sheets

METHOD AND APPARATUS FOR MELT SPINNING A MULTIFILAMENT YARN

BACKGROUND OF THE INVENTION

The invention relates to a method and apparatus for spinning a multifilament yarn from a thermoplastic material, and of the general type disclosed in EP 0 682 720 and corresponding U.S. Pat. No. 5,976,431.

In the spinning by the known method and apparatus, an air stream assists the freshly extruded filaments in their advance. With that, it is accomplished that the solidification zone of the filaments moves away from the spinneret. This again leads to a delayed crystallization, which has a favorable effect on the physical properties of the yarn. For example, in the production of a POY yarn, it was possible to increase the withdrawal speed and, thus, the draw ratio, without changing the elongation values for the yarn, which are necessary for its further processing.

To this end, the known apparatus comprises downstream the spinneret, a cooling device, which includes an upper cooling shaft and a lower cooling shaft connected to the upper cooling shaft. At its outlet end, the lower cooling shaft connects to a cooling stream generator, which generates a vacuum in the lower cooling shaft. The upper cooling shaft is made gas permeable, so that the vacuum prevailing in the lower cooling shaft causes an air stream to flow into the upper cooling shaft and to advance in the direction of the lower cooling shaft. In so doing, a coolant stream is generated, which has a flow velocity substantially equal to the advancing speed of the filaments. This influences friction between the filaments and the adjacent air layer such that crystallization starts with a delay, and the filaments solidify in a solidification zone within the lower cooling shaft.

However, it has shown that in the spinning of fine filament deniers, for example 1 dtex/f or less, crystallization in the filaments has progressed, after a precooling in a cooling zone formed by the upper cooling shaft, to such an extent that the subsequent assistance in the continuing advance no longer shows a significant influence for delaying crystallization.

U.S. Pat. No. 4,277,430 discloses a method and apparatus, wherein the filaments are cooled in the cooling zone downstream of the spinneret by directing thereto a transverse air flow. Subjacent the cooling zone is a second cooling shaft, which receives in its inlet area an air/water mixture as a misty cooling stream. For cooling the yarn, the misty cooling stream is caused to flow by means of suction in the direction of the advancing yarn to the end of the cooling zone. In this process, the addition of liquid realizes a yet greater cooling effect on the filaments, so that the onset of crystallization is not delayed, but accelerated.

It is an object of the present invention to further develop a method of the initially described kind as well as an apparatus for carrying out the method in such a manner that it becomes possible to produce yarns with low, medium, or high deniers at higher production speeds and with uniform physical properties.

SUMMARY OF THE INVENTION

The invention is based on the knowledge that from their emergence from the spinneret to their solidification and formation of the yarn, crystallization of the filaments is determined by two mutually influencing effects. It is known that during the cooling of a polymer melt, the melt solidifies at a certain temperature. This process is dependent solely on the temperature, and herein named thermal crystallization. In the spinning of yarns, a filament bundle is withdrawn from the spinnerets. In this process, the yarn is subjected to withdrawal forces, which effect a tension-induced crystallization in the filaments. Thus, in the spinning of yarns, thermal crystallization and tension-induced crystallization are superposed, and jointly lead to the solidification of the filaments. To influence tension-induced crystallization, the filament bundle is guided, prior to its solidification, into a tension zone, in which the yarn friction and, thus, the yarn tension acting upon the yarn are changed.

Thus, the invention makes available a method and an apparatus, which make it possible to influence tension induced crystallization under substantially unchanged conditions. To this end, the cooling of the filaments, after their emergence from the spinneret, is adjusted within the cooling zone such that the location of the solidification zone of the filaments is kept within the tension zone in a predetermined desired range thereof. Thus, solidification of the filaments in the tension zone in the lower cooling shaft always occurs essentially in the same place, so that a uniform treatment of the filaments is ensured for influencing tension induced crystallization. To influence thermal crystallization, it is necessary that the cooling effects, which the coolant exerts in the cooling zone, be made variable. However, in this connection, it is necessary that before their entry into the tension zone, the filaments already have a certain stability, in particular in their outer edge layers, for purposes of withstanding undamaged the coolant stream, which is generated in the tension zone for treating the yarn tension. A particularly advantageous variant for controlling the cooling is provided by a further development of the invention, wherein the coolant is tempered before entering the cooling zone. In this instance, the temperature of the coolant may be increased to a value preferably in a range from 20° C. to 300° C. To spin, for example, a yarn with a relatively low filament denier, the coolant is preheated to a higher temperature by a heating device, which is used as a means. This influences thermal crystallization in such a manner that the filament bundles are not solidified before they enter the tension zone. Thus, an advantageous tension treatment is possible by a coolant stream directed parallel to the filaments. This stream causes the filaments to solidify in the desired range of the tension zone. In the case that it is intended to spin a yarn of a high denier, the coolant will be adjusted to a lower temperature, so that before entering the tension zone, thermal crystallization has developed so far that the filaments exhibit adequate stability when they are attacked by the coolant stream.

To adjust cooling in the cooling zone, a further advantageous improvement of the invention proposes to change the volume flow of the coolant. The means used to this end is a blower, which can be used to control the volume flow that is blown into the cooling zone.

At this point, it should be noted that basically all known means for influencing the cooling effect in the cooling zone are suitable for using the method of the present invention for spinning a yarn. The herein described means are especially suited for the instance, when a cooling air is used as coolant. For example, when a vaporous coolant is used, it would be possible to influence the cooling effect solely by the state of the vapor. Likewise, it is possible to use means in the form of devices for influencing cooling in the cooling zone, such as, for example, movable sheet elements, which influence the entry of the coolant into the cooling zone.

To ensure a great uniformity in the spinning of the filaments, a preferred further development of the invention provides that the coolant stream is accelerated to the flow velocity necessary for treating the tension of the filament bundle, only in an acceleration zone within the tension zone. In so doing, the coolant stream is accelerated at least to a flow velocity, which equals the speed of the advancing filaments, so that the filaments are not decelerated in their continuing movement. Thus, for reaching an optimal tension induced crystallization, the desired zones for solidifying the filaments extend within or directly downstream of the acceleration zone of the coolant.

The coolant stream in the tension zone may be generated from the coolant leaving the cooling zone and from a coolant supplied in the inlet area of the tension zone downstream of the cooling zone. This construction permits the tension induced crystallization to be adjustable within a wide range. The additionally supplied coolant further permits an influencing of the cooling of the filament bundle in the tension zone. In particular, in the spinning of yarns with high deniers, the supply of an additional coolant makes it possible to achieve a desired minimum cooling at the outlet end of the tension zone when the yarn is combined.

The method of the present invention is independent of whether the coolant stream is generated in the tension zone by a suction effect or by a blowing action. The variant of the method, wherein a suction flow prevails in the tension zone, has the advantage that thermal crystallization in the cooling zone and tension induced crystallization in the tension zone can be influenced substantially independently of each other.

To generate a coolant stream by a blowing action, it is possible to blow the coolant into the cooling zone and to guide it correspondingly into the tension zone, or to blow the coolant supplied downstream of the cooling zone directly into the tension zone.

To obtain an effect of the coolant stream, which is as uniform as possible on each filament of the filament bundle, the tension zone may be formed by a cooling duct through which the filaments advance, and which has on its inlet end a narrowed cross section which operates as an acceleration zone for the air entering the duct.

Based on its flexibility, the method of the present invention is especially suited for spinning yarns of polyester, polyamide, or polypropylene. An aftertreatment of the yarn, which is suitable after spinning, makes its possible to use the method for producing, for example, a fully drawn yarn (FDY), a partially oriented yarn (POY), or a highly oriented yarn (HOY)

The method of the present invention can be carried out very advantageously by an apparatus, wherein the cooling device comprises an upper cooling shaft and a lower cooling shaft. The upper cooling shaft extends directly downstream of the spinneret, and forms a cooling zone, in which thermal crystallization is influenced by a coolant introduced into the cooling shaft. The lower cooling shaft connects to the upper cooling shaft, and forms the tension zone. To generate a coolant stream flowing parallel to the yarn, the cooling device includes a cooling stream generator. This cooling stream generator is used to generate a coolant stream with a predetermined flow velocity. According to the invention, the apparatus for carrying out the method comprises a means for adjusting the cooling of the filaments in the upper cooling shaft. This means permits influencing the cooling of the filaments in such a manner that the filaments solidify only in a predetermined desired range of the lower cooling shaft. Thus, the apparatus of the present invention is suitable for changing the location of the solidification zone of the filaments along the spin line, in particular in the region of the lower cooling shaft. It is possible to use as means both such devices, which are operative on the cooling device and such devices, which directly act upon the coolant.

Advantageously, with the use of cooling air, the means is designed and constructed as heating device, which tempers the cooling air entering the lower cooling shaft. In this instance, the heating device is operated via a controller with corresponding, predetermined control values.

To generate in the lower cooling shaft an as uniform coolant stream as possible, it is especially advantageous to form an acceleration zone in the cooling shaft by means of a narrowed cross section. A coolant entering the lower cooling shaft is thus accelerated to a flow velocity, which essentially depends on the pressure difference prevailing between the inlet side and the interior of the lower cooling shaft.

To generate the pressure difference for developing a coolant stream in the lower cooling shaft, it is possible to utilize as the cooling stream generator both a blower, which blows the coolant into the lower cooling shaft, and a source of vacuum, which connects to the lower cooling shaft on the outlet side thereof, and sucks the coolant into the lower cooling shaft.

To produce qualitatively superior yarns, the lower cooling shaft may be formed by a tube, through which the filament bundle advances. The inlet end mounts a condenser and the outlet end a diffuser. The condenser generates a uniform coolant stream, which surrounds the filament bundle. The diffuser produces a slow decrease of the flow velocity of the coolant stream, so that the filament bundle advances through the lower cooling shaft substantially with little turbulence.

To improve the smooth run of the filament bundle and to avoid stronger turbulence in the cooling shaft, a very advantageous further development of the apparatus provides for a second condenser between the upper and the lower cooling shafts. This second condenser ensures a substantially turbulencefree transition of the coolant from the upper cooling shaft to the lower cooling shaft. In this instance, the acceleration zone, which is characterized by the narrowest flow cross section, may be formed both in the first or in the second condenser. To increase the cooling effect, in particular in the case of coarse yarn deniers, it will be advantageous to introduce an additional coolant into the tension zone between the two condensers.

BRIEF DESCRIPTION OF THE DRAWINGS

Some embodiments of the apparatus according to the invention as well as advantageous effects of the method according to invention are described in greater detail below with reference to the drawings, in which.

DETAILED DESCRIPTION OF THE PREFERRED EMBODIMENTS

Figure 1:
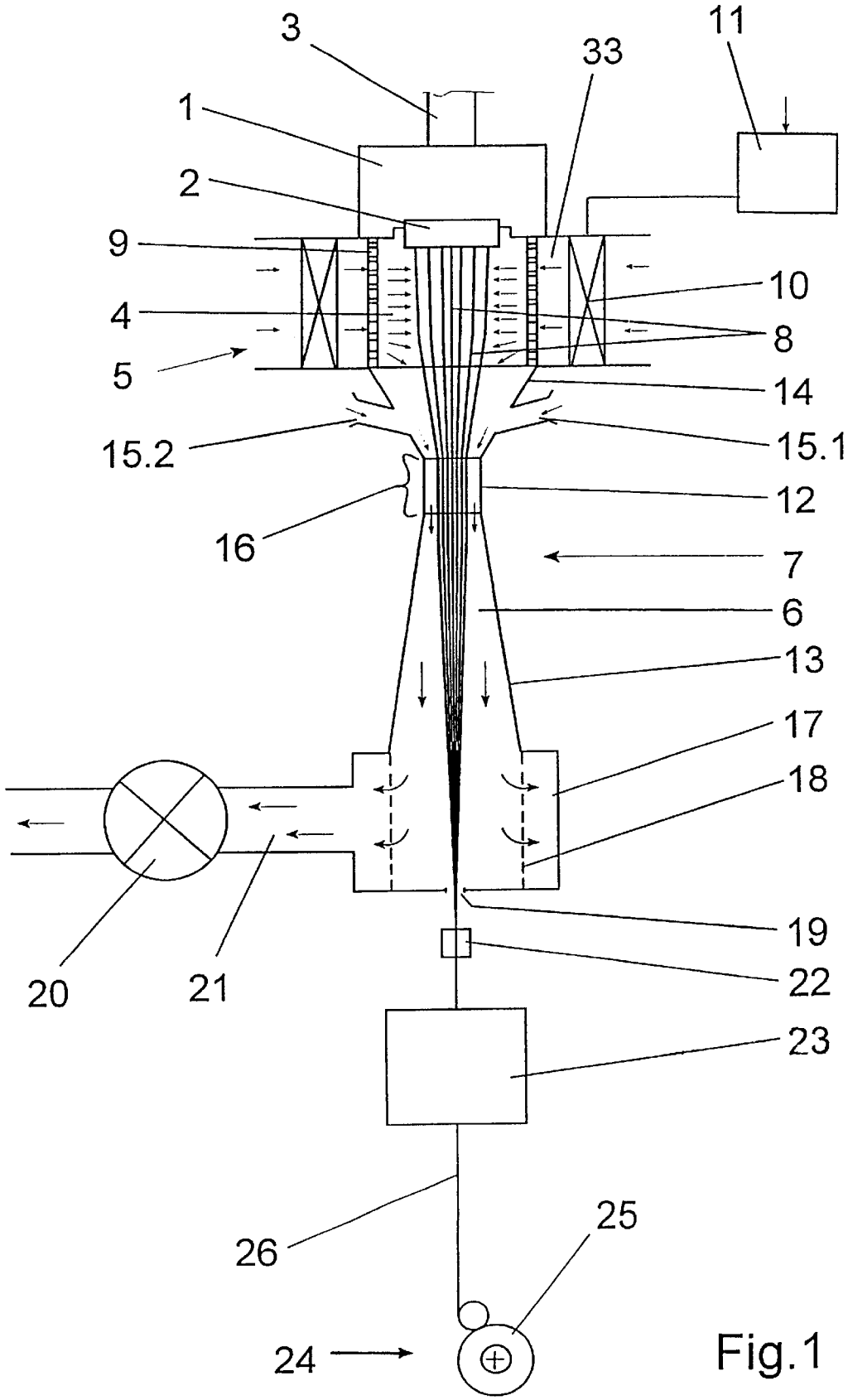
FIG. 1 is a schematic view of a first embodiment of an apparatus according to the invention for carrying out the method of the present invention.

FIG. 1 schematically illustrates a first embodiment of an apparatus according to the invention for spinning a multifilament yarn, and wherein a yarn 26 is spun from a thermoplastic material and wound to a package 25 at the takeup device 24. To this end, the thermoplastic material is melted in an extruder and a spin pump (not shown) delivers the melt via a melt line 3 to a heated spin head 1. The underside of spin head 1 mounts a spinneret 2. From the spinneret 2, the melt emerges in the form of fine strands or filaments 8. The filaments 8 advance through a cooling zone 4, which is formed by an upper cooling shaft 5. To this end, the cooling shaft 5 is arranged directly downstream of spin head 1, and surrounds the filaments 8 with a gas permeable wall 9. On the external side of walls 9, the cooling shaft 5 comprises an air intake 33, which is open to the surroundings. In the air intake 33, a heater 10 is arranged, which heats an air stream introduced from the outside, before same enters the gas permeable wall 9. The heater 10 is connected to a controller 11.

In the direction of the advancing yarn downstream of the upper cooling shaft 5, a second cooling shaft 7 extends, which forms a tension zone 6 for influencing the yarn friction and, thus, a tension-induced crystallization. The lower cooling shaft 7 is designed and constructed as a tube 12. On the inlet side of cooling shaft 7, the tube 12 mounts a condenser 14, which connects to the outlet side of the upper cooling shaft 5. The wall of condenser 14 contains a plurality of inlet openings 15.1 and 15.2. The embodiment shows, for example, two inlet openings, which are arranged in symmetric relationship with the circumference of the condenser 14. On the outlet side of the lower cooling shaft, the tube 12 comprises a diffuser 13, which terminates in an outlet chamber 17. In its underside, the outlet chamber 17 contains an outlet opening 19 in the plane of the advancing yarn. On one side of outlet chamber 17, a suction line 21 terminates in outlet chamber 17. The suction line 21 connects to a vacuum generator 20. The vacuum generator 20, which may be designed and constructed, for example, as a pump or blower, generates a vacuum in outlet chamber 17 and, thus, in tube 12. The lower cooling shaft 7 forms the tension zone 6, which influences the yarn friction on the filament bundles.

Downstream of outlet chamber 17, a yarn lubricator 22 and a treatment device 23, as well as the takeup device 24 extend in the plane of the advancing yarn. As a function of the production process, the treatment device may include, for example, an entanglement nozzle or a draw zone, so that the yarn can be influenced in its tension and drawn, before it is wound. Likewise, there exists the possibility of arranging within the treatment device 23 additional heaters for drawing or relaxing.

In the apparatus shown in FIG. 1, a thermoplastic material advances in a molten state to the spin head 1. Via the spinneret 2, the material is extruded as strands of filaments 8 from a plurality of nozzle bores. The takeup device 24 withdraws the bundle formed by filaments 8. In so doing, the filaments 8 advance at an increasing speed through the cooling zone 4 inside the upper cooling shaft 5. Subsequently, the filaments enter, via condenser 14, the tension zone 6 of the lower cooling shaft 7. In the tube 12 of the lower cooling shaft 7, the vacuum generator 20 generates a vacuum. Due to the vacuum and due to a self-suction effect generated by the movement of the filaments, an air stream is sucked from the outside through air intake 33 into the cooling zone 4 in the upper cooling shaft. Before entering the cooling zone 4, the air stream is heated to a predetermined temperature by heater 10. The control of the heater occurs through controller 11. Thus, the filaments are precooled in the cooling zone 4 by a coolant of a predetermined temperature. After their passage through the cooling zone 4, the filaments 8 enter tension zone 6. In this process, the air entering the cooling zone 4 is entrained or taken in. Inside the condenser 14, additional cooling air is sucked in from the outside through inlets 15.1 and 15.2. The air exiting from the cooling zone 4, and the air entering via inlets 15.1 and 15.2 are accelerated together to a coolant stream in an acceleration zone 16 in tube 12. In the acceleration zone 16, the air flow is accelerated due a narrowest cross section in tube 12 by the action of vacuum generator 20 in such a manner that an air flow acting against the filament movement in the tube is no longer present. This reduces the stress on the filaments and thus the yarn tension. The filaments, which are solidified due to thermal crystallization substantially only in their edge regions after having undergone a precooling in cooling zone 4, will solidify within the tension zone 6 by a delayed, tension-induced crystallization in a defined, desired range inside the lower cooling shaft 7. This desired range extends from the acceleration zone 16 to an inlet area leading into the diffuser 13. In this process, the filaments undergo further cooling.

To generate in the outlet area of lower cooling shaft 7 as little turbulence as possible, the air flow is introduced into outlet chamber 17 via diffuser 13. To further steady the air, the outlet chamber 17 contains a screen cylinder 18, which surrounds the filament bundle. Subsequently, the air is removed from the outlet chamber 17 by suction and discharged via suction line 21 and vacuum generator 20.

The filaments 8 emerge from the underside of outlet chamber 17 through outlet opening 19, and enter yarn lubricator 22. By the time the filaments 8 leave lower cooling shaft 7, they have undergone a complete cooling. The yarn lubricator 22 combines the filaments 8 to a yarn 26. After a treatment, the yarn 26 is wound with takeup device 24 to a package 25. The arrangement shown in FIG. 1 can be used to produce, for example, a polyester yarn, which is wound at a takeup speed greater than 7,000 m/min.

The apparatus shown in FIG. 1 is characterized in that the air entering the cooling zone is heated to a predetermined temperature before its entry. This may be advantageously used for influencing thermal crystallization within the cooling zone in such a manner that the filaments 8 are able to enter tension zone 6 in a not-yet solidified state. The precooling of the filaments is adjusted such that they solidify in a predetermined desired range within the tension zone 6. Normally, this desired range is located in tube 12, in or directly downstream of the acceleration zone 16. With that, it is accomplished that the air flow for influencing the yarn friction acts upon the filaments before their solidification. As a result of this advantageous treatment of the filaments, tension-induced crystallization is delayed in such a manner that it ensures an increase in the production of yarn with unchanged, satisfactory physical properties. The air additionally supplied on the inlet side of the lower cooling shaft 7 further accomplishes an adequate cooling effect despite a parallel-oriented flow in the tension zone.

Figure 2:
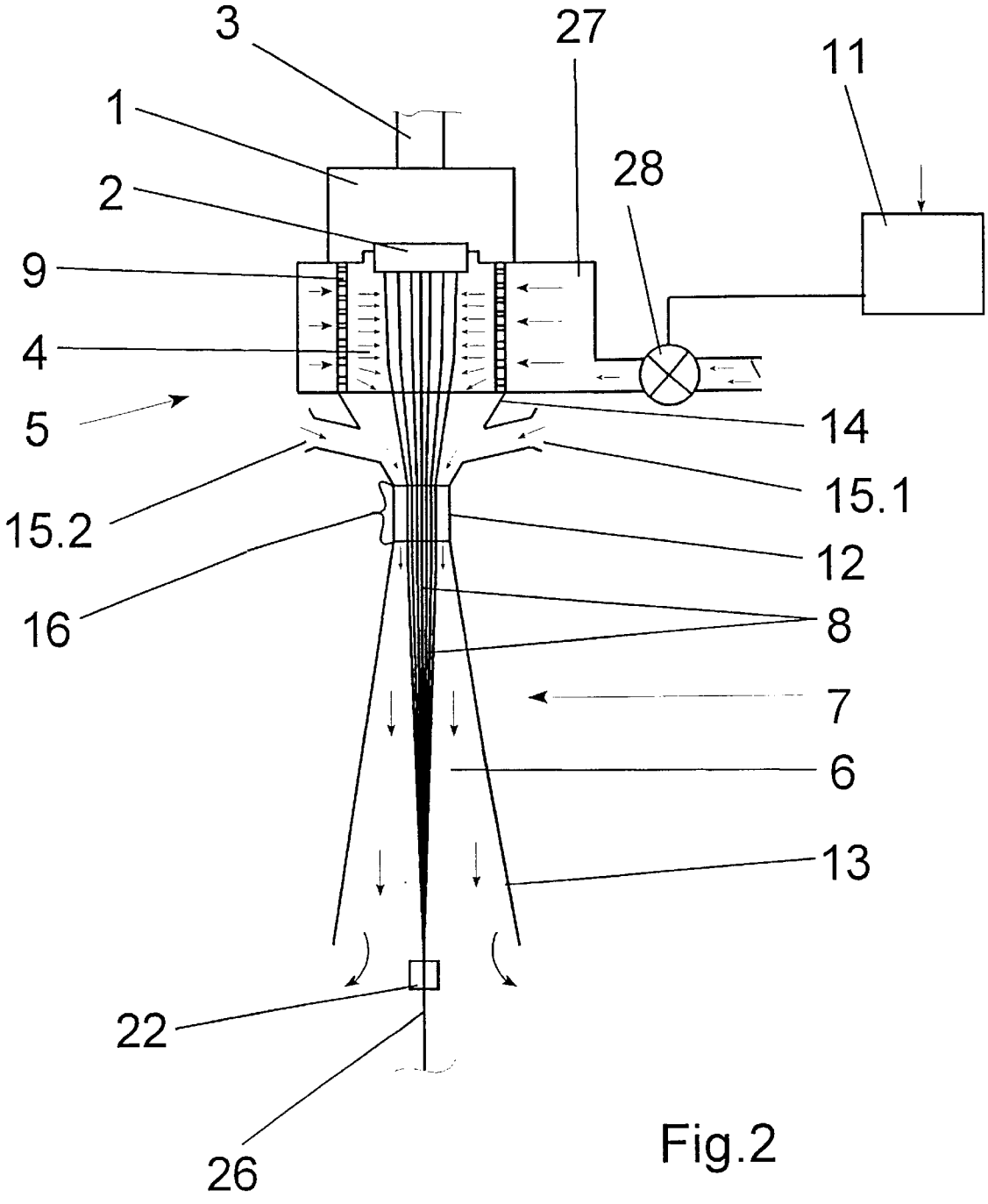
FIGS. 2–4 are schematic views of further embodiments of the apparatus according to the invention.
Figure 3:
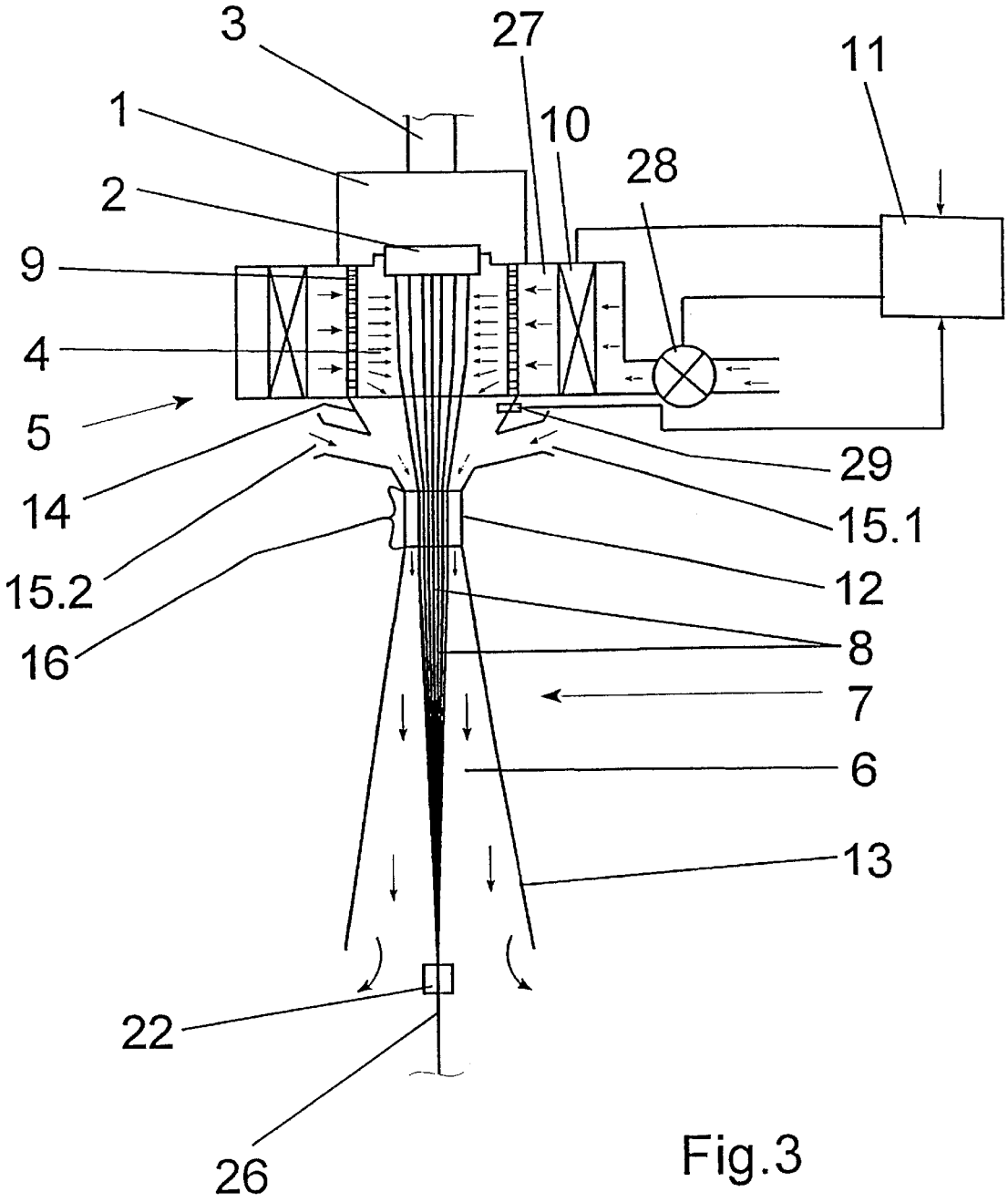
Figure 4:
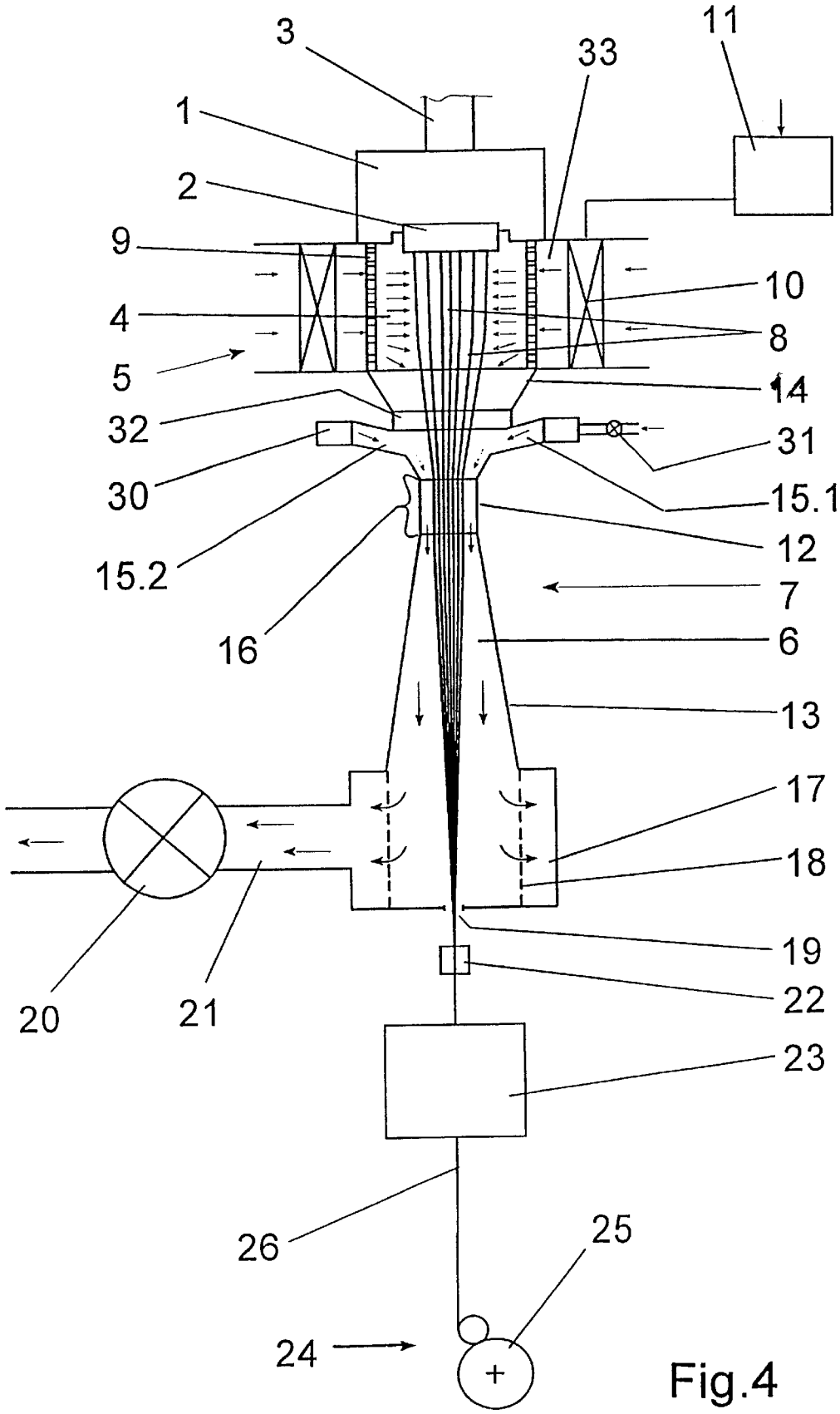

FIGS. 2–4 illustrate further embodiments of the apparatus according to the invention. In these embodiments, the cooling devices are modified in different ways for purposes of varying both the coolant in the cooling zone and the coolant stream in the tension zone. The basic construction of the apparatus shown in FIGS. 2–4 is substantially identical with the apparatus of FIG. 1. To this extent, the foregoing description is herewith incorporated by reference.

FIG. 2 illustrates an embodiment of the apparatus according to the invention, wherein the cooling device comprises likewise an upper cooling shaft 5 and a lower cooling shaft 7. In the cooling zone 4 downstream of spinneret 2, the filaments are surrounded by gas-permeable wall 9. On the outer side of wall 9, an air chamber 27 is formed. The air chamber 27 connects to a blower 28. The blower 28 causes a coolant to enter air chamber 27. The blower 28 connects to a controller 11.

On the outlet side of the upper cooling shaft 5, the lower cooling shaft 7 connects thereto via condenser 14. In the condenser 14, a plurality of inlet openings 15.1 and 15.2 are formed, through which an air stream is supplied to the tension zone. The lower cooling shaft is made cylindrical with the tube 12, which connects on its inlet side to condenser 14, and on its outlet side to diffuser 13. On the outlet side of the lower cooling shaft 7, the tube 12 or diffuser 13 comprises an outlet opening 34, through which the filaments and the coolant stream are able to leave.

To generate the coolant stream in tension zone 6, the blower 28 causes cooling air to enter the upper cooling shaft 5 in cooling zone 4. In this instance, it is preferred to generate an overpressure in the air chamber 27. This causes the coolant introduced into the cooling zone to flow toward the tension zone 6 and to accelerate in acceleration zone 16 because of the narrowed cross section. In this process, an additional air stream is taken in through inlet openings 15.1 and 15.2. This additional airstream advances together with the blown-in cooling air through the tension zone 6. However, it is also possible to connect the inlets 15.1 and 15.2 to blower 28, so that the additional air stream is blown into the tension zone 6. To control thermal crystallization in cooling zone 4, the blower 28 is operated at a rotational speed that is predetermined by controller 11, so that a predetermined amount of air enters the cooling zone for precooling.

FIG. 3 schematically illustrates a further embodiment, which is substantially identical with the embodiment of FIG. 2. To this extent, the foregoing description is herewith incorporated by reference, and reference is made only to the illustrated differences.

In the apparatus shown in FIG. 3, a heater 10 is integrated in air chamber 27 of the upper cooling shaft such that the air entering cooling zone 4 is previously heated to a predetermined temperature. In this connection, the heater 10 and the blower 28 are connected to controller 11 and are controlled accordingly via same. On the outlet side of the upper cooling shaft, a measuring device 29 is arranged such that the temperature of the exiting air or the temperature of the filaments is measured. The measuring device 29 connects to controller 11.

The apparatus shown in FIG. 3 makes it possible to adjust during the process the location of the solidification zone of the filaments within the tension zone 6. Since both thermal crystallization and tension-induced crystallization are dependent on the temperature, it is possible to use with advantage the measurement of the temperature in the transitional region from cooling zone 4 to tension zone 6 for maintaining a predetermined location of the solidification zone. To this end, the measured temperature is supplied to controller 11. In the controller 11, an adjustment occurs between a predetermined desired value and the measured actual value. In the case of a control deviation, the controller 11 will supply corresponding control pulses to heater 10, or to blower 28, or to both units. This apparatus is therefore especially suited for maintaining a certain level of the solidification zone irrespective of external influences.

FIG. 4 illustrates a further embodiment of the apparatus according to the invention. This embodiment is essentially designed and constructed in the same way as the apparatus shown in FIG. 1, except that inlets 15.1 and 15.2 connect to an annular chamber 30. The annular chamber 30 connects to a blower 31. With that, it is accomplished that upstream of acceleration zone 16, additional cooling air is blown into the tension zone 6. Between the upper cooling shaft 5 and inlets 15, a second condenser 32 extends in substantially coaxial relationship with condenser 14 of the lower cooling shaft 7. As a result, the cooling air leaving cooling zone 4 is supplied to the tension zone 6 preaccelerated without significant turbulence. The coolant stream formed in the acceleration zone 16 is thus composed of the cooling air leaving the cooling zone and the blown-in cooling air. In the tension zone 6, the coolant stream is generated by the action of vacuum generator 20 on the outlet side of lower cooling shaft 7.

The embodiment of the apparatus according to the invention as shown in FIG. 4 may also be modified in a simple manner such that the acceleration zone 16 is formed by the first condenser 14 directly in the inlet area of tension zone 6. Such a construction permits introducing into the tension zone downstream of the acceleration zone, the coolant which is additionally supplied into the lower cooling shaft 7 via inlets 15. Such a construction has the advantage that it prevents turbulence in the edge region of the diffuser as the accelerated coolant expands.

In their construction, the apparatus shown in FIGS. 1–4 are exemplary. Thus, it would be possible to combine the embodiment shown in FIG. 4 with a coolant generation shown in FIG. 3. For example, it would be possible to design and construct the upper cooling shaft as a so-called cooling system operating with a transverse air stream, wherein the cooling air impacts upon the filament bundle from only one side. Likewise, it is possible to construct the lower cooling shaft in box shape for receiving a plurality of yarns. In this instance, the side walls of the lower cooling shaft shown in FIG. 1 would be lengthened perpendicular to the plane of the drawing.

What is claimed is:

1. A process for melt spinning a multifilament yarn comprising the steps of extruding a heated polymeric melt through a spinneret to form a plurality of downwardly advancing filaments which are initially in liquid form, precooling the filaments by contact with a coolant which is introduced into a cooling zone which is located downstream of the spinneret, in such a manner that the filaments do not solidify within the cooling zone, further cooling the filaments in a tension zone located downstream of the cooling zone by contact with a coolant stream in such a manner that the filaments solidify within the tension zone, adjustably controlling the cooling of the filaments within the cooling zone in such a manner that the location of the solidification of the filaments within the tension zone is maintained within a predetermined desired range, and gathering the advancing filaments downstream of the tension zone to form an advancing multifilament yarn, and then winding the advancing yarn into a package.

2. The process as defined in claim 1 wherein the step of adjustably controlling the cooling of the filaments includes varying the temperature of the coolant before its entry into the cooling zone.

3. The process as defined in claim 1 wherein the step of adjustably controlling the cooling of the filaments includes varying the volume flow of the coolant before its entry into the cooling zone.

4. The process as defined in claim 1 wherein the coolant stream is accelerated in an acceleration zone within the tension zone, and wherein the location of the solidification of the filaments within the tension zone is maintained in or immediately downstream of the acceleration zone.

5. The process as defined in claim 1 wherein the coolant is introduced into the cooling zone and then caused to advance into the tension zone to form at least a portion of the coolant stream.

6. The process as defined in claim 5 wherein the coolant stream is formed from the coolant leaving the cooling zone and from a coolant supplied directly into an upstream end portion of the tension zone.

7. The process as defined in claim 5 wherein the coolant stream is generated in the tension zone by a suction effect.

8. The process as defined in claim 5 wherein the coolant stream is generated in the tension zone by a blowing effect.

9. The process as defined in claim 1 wherein the tension zone is formed by a duct through which the filaments advance, with the duct comprising adjacent its upstream end a narrowed cross section which operates as an acceleration zone.

10. The process as defined in claim 1 wherein the coolant is introduced into the cooling zone by a suction effect or by a blowing effect.

11. The process as defined in claim 1 comprising the further subsequent steps of gathering the advancing filaments to form an advancing multifilament yarn, and then winding the yarn into a package.

12. The process as defined in claim 1 wherein the polymeric melt is selected from the group consisting of polyester, polyamide, and polypropylene.

13. A melt spinning apparatus for producing a multifilament yarn, comprising an extruder for heating a polymeric material and extruding the resulting melt through a spinneret to form a plurality of downwardly advancing filaments which are initially in liquid form, a cooling device disposed below the spinneret for cooling the advancing filaments and comprising an upper cooling shaft defining a cooling zone and having a gas permeable side wall, and a lower cooling shaft defining a tension zone disposed below the upper cooling shaft, at least one cooling stream generator for causing a coolant to enter the upper cooling shaft through the air permeable side wall and for causing a coolant stream directed in the direction of the advancing filaments to flow through the lower cooling shaft, and means for adjusting the cooling for the filaments in the upper cooling shaft so that the location of the zone in which the filaments solidify is maintained within a predetermined desired range in the lower cooling shaft.

14. The melt spinning apparatus as defined in claim 13 wherein the means for adjusting the cooling of the filaments comprises a heater positioned to heat the coolant before entering the upper cooling shaft.

15. The melt spinning apparatus as defined in claim 13 wherein the means for adjusting the cooling of the filaments comprises a blower which is able to vary the volume flow of the coolant before entering the upper cooling shaft.

16. The melt spinning apparatus as defined in claim 13 wherein the lower cooling shaft includes an acceleration zone defined by a narrowed cross section for the purpose of accelerating the coolant stream, with the acceleration zone being positioned upstream of the predetermined desired range for solidifying the filaments.

17. The melt spinning apparatus as defined in claim 13 wherein the upper cooling shaft is connected directly to the lower cooling shaft, and wherein the lower cooling shaft includes a coolant inlet located immediately downstream of the upper cooling shaft.

18. The melt spinning apparatus as defined in claim 17 wherein the cooling stream generator comprises a blower for blowing coolant into the lower cooling shaft via said inlet.

19. The melt spinning apparatus as defined in claim 13 wherein the cooling stream generator is a vacuum generator which is connected to a downstream portion of the lower cooling shaft so as to draw coolant into the lower cooling shaft.

20. The melt spinning apparatus as defined in claim 13 wherein the lower cooling shaft comprises a tube which has on its inlet end a condenser and on its outlet end a diffuser, with the condenser and diffuser being connected at their most narrow cross sections.

21. The melt spinning apparatus as defined in claim 20 wherein the lower cooling shaft further comprises a second condenser located between the upper cooling shaft and the first mentioned condenser, and a coolant inlet arranged between the two condensers.

22. The melt spinning apparatus as defined in claim 13 further comprising guide means for gathering the advancing filaments to form an advancing multifilament yarn, and a winder for winding the advancing yarn into a package.

23. The melt spinning apparatus as defined in claim 22 wherein the guide means is positioned adjacent a downstream end of the lower cooling shaft.

* * * * *